US008474542B2

(12) United States Patent
Blanton et al.

(10) Patent No.: US 8,474,542 B2
(45) Date of Patent: Jul. 2, 2013

(54) SELECTIVE AND NON-SELECTIVE LOCK MANDREL ASSEMBLY HAVING UPWARD BIASED INNER SLEEVE

(75) Inventors: Tracy Dean Blanton, Houston, TX (US); Steven Carl Guy, Tomball, TX (US)

(73) Assignee: Weatherford/Lamb, Inc., Houston, TX (US)

( * ) Notice: Subject to any disclaimer, the term of this patent is extended or adjusted under 35 U.S.C. 154(b) by 305 days.

(21) Appl. No.: 12/869,274

(22) Filed: Aug. 26, 2010

(65) Prior Publication Data

US 2012/0012338 A1 Jan. 19, 2012

Related U.S. Application Data

(60) Provisional application No. 61/364,494, filed on Jul. 15, 2010.

(51) Int. Cl.
*E21B 23/02* (2006.01)

(52) U.S. Cl.
USPC ..... 166/381; 166/217

(58) Field of Classification Search
USPC ..... 166/118, 134, 217, 237, 381, 86
See application file for complete search history.

(56) References Cited

U.S. PATENT DOCUMENTS 3,051,243 A * 8/1962 Grimmer et al. ..... 166/332.7
3,507,329 A * 4/1970 Stone, Jr. ..... 166/214
3,856,081 A 12/1974 Canalizo
4,295,528 A 10/1981 Carmody
4,396,061 A 8/1983 Tamplen et al.
4,479,539 A * 10/1984 Tamplen et al. ..... 166/212
4,510,995 A * 4/1985 Krause et al. ..... 166/217
4,545,434 A 10/1985 Higgins
4,583,591 A 4/1986 Krause, Jr. et al.
4,745,974 A 5/1988 Higgins
4,767,145 A 8/1988 Bullard
4,883,121 A 11/1989 Zwart
4,944,345 A * 7/1990 Mashaw, Jr. ..... 166/206
4,997,038 A 3/1991 Welch
5,379,837 A * 1/1995 Reid ..... 166/208
5,390,735 A 2/1995 Williamson, Jr.

(Continued)

OTHER PUBLICATIONS

International Search Report and Written Opinion in counterpart PCT Appl. No. PCT/US2011/036595, mailed Sep. 2, 2011.

(Continued)

*Primary Examiner* — Daniel P Stephenson
(74) *Attorney, Agent, or Firm* — Wong, Cabello, Lutsch, Rutherford & Brucculeri, L.L.P.

(57) ABSTRACT

Selective and non-selective lock mandrel assemblies include a lock mandrel affixing to a running tool. A collet on the tool holds an inner mandrel in a downhole position in the lock mandrel. For the non-selective assembly, a biased key on the lock mandrel extends into a nipple profile, and shoulders on the key and profile stop further run-in. Operators shear a first shear pin on the running tool by jarring down, and the collet moves and releases its hold on the inner mandrel. Freed, the inner mandrel biased by a spring moves to an uphole position, and a flange fits behind the extended key to lock it in the profile. For the selective assembly, the biased key is held retracted until activated using locator dogs on the running tool to engage a transition when running uphole. Once the lock mandrel is set, operators detach the running tool from it.

32 Claims, 15 Drawing Sheets

U.S. PATENT DOCUMENTS

| | | | | |
|---|---|---|---|---|
| 5,409,059 | A | 4/1995 | McHardy | |
| 5,538,082 | A | 7/1996 | Zwart | |
| 5,865,255 | A | 2/1999 | Hammett et al. | |
| 6,209,653 | B1 * | 4/2001 | Pringle | 166/382 |

OTHER PUBLICATIONS

Wireline Solutions, LLC., Brochure Entitled "Blanking Plugs," undated, obtained from http://www.wirelinesolutions.net/uploads/Blanking_Plugs.pdf.

Otis Engineering Corp., "Landing Nipples and Lock Mandrels," p. 94, undated, obtained from https://przetargi.pgnig.pl/servlet/HomeServlet?MP_action=repository&MP_method=show_document_for_all&fileId=23300.

Weatherford, "WX Nipple Selective," obtained from www.weatherford.com, (c) 2007-2009, No. 2502.02, 2 pgs.

Weatherford, "Wireline-Retrievable Latches for Side-Pocket Mandrels," obtained from www.weatherford.com, (c) 2005, No. 1349.00, 2 pgs.

Weatherford Product Catalog, "Uniset Flow Control System," obtained from www.weatherford.com, (c) 2006, Brochure 1200.00, 58 pgs.

Weatherford, "Petroline Heavy-Duty Wireline Fishing Services," obtained from www.weatherford.com, (c) 2005-2006, Brochure 247.01, 28 pgs.

Weatherford, "Optimax Series Safety-Valve Lock Model OQXSV," obtained from www.weatherford.com, (c) 2008, No. 2646.00, 4 pgs.

Weatherford, "Weatherford WX Selective Test Tool," obtained from www.weatherford.com, (c) 2009, No. 2504.00, 2 pgs.

* cited by examiner

SELECTIVE AND NON-SELECTIVE LOCK MANDREL ASSEMBLY HAVING UPWARD BIASED INNER SLEEVE

CROSS-REFERENCE TO RELATED APPLICATIONS

This is a non-provisional of U.S. Provisional Appl. Ser. No. 61/364,494, filed 15 Jul. 2010, which is incorporated herein by reference and to which priority is claimed.

BACKGROUND

Lock mandrels can be used to support different flow accessories needed for well control downhole. Typically, the accessory attaches to the lower end of the lock mandrel, and a running tool is located within the lock mandrel from the upper end to run the mandrel and accessory downhole. Then, the lock mandrel with accessory is run-in and set in the well. Once positioned in the well, the running tool is removed, and the lock mandrel anchors and seals the accessory in position in the well's tubing string.

One type of prior art lock mandrel 10 is shown in FIGS. 1A-1B in unlocked and locked conditions. This lock mandrel 10 is commonly referred to as an "Otis X" lock mandrel or standard style lock mandrel with collapsing fishing neck. The lock mandrel 10 is similar to that disclosed in U.S. Pat. No. 4,396,061 to Tamplen et al. As shown, the lock mandrel 10 has a tubular body with a packing element 13 and a retainer sleeve 14 disposed thereon. Locking dogs 20 are carried by the retainer sleeve 14, and a locking sleeve 16 can move on the body 12 within the retainer sleeve 14 between a retracted position (FIG. 1A) and a locked position (FIG. 1B). As in FIG. 1A, a flange 17 on the retracted locking sleeve 16 is moved away from the dogs 20. However, when moved to the locked position (FIG. 1B), the flange 17 expands the dogs 20 outward to engage in a nipple profile.

In use, the lock mandrel 10 is assembled in a run-in condition (FIG. 1A) on a running tool (not shown), and the assembly is run into a well bore on a wireline. The spring 24 biases the locking dogs 20 inwardly so that the dogs remain retracted. Eventually, the locking mandrel 10 lowers below a landing nipple in which it is to be landed. At this point, operators lift the lock mandrel 10 above the landing nipple profile 30 and then lower it again toward the landing nipple. This lowering of the lock mandrel 10 causes the locking sleeve 16 to be moved downwardly to an intermediate position so that the spring 24 urges the locking dogs 20 outwardly against the wall of the flow conductor.

Operators then continue lowering the lock mandrel 10 until the dogs 20 engage the landing nipple profile 30. When engaged, shoulders 22 on the dogs 20 mate with a comparable shoulder 32 on the landing nipple's profile 30. Downward jarring forces then drive the locking sleeve 16 downwardly to the locked position (FIG. 1B). At this point, the locking sleeve 16 supports the dogs 20 in their extended position locked into the landing nipple's profile 30.

Another type of prior art lock mandrel 50 is shown in FIG. 2. This lock mandrel 50 is commonly referred to as a "uniset" lock mandrel and is similar to that disclosed in U.S. Pat. No. 4,883,121 to Zwart. Rather than having a downwardly travelling inner sleeve or mandrel, this type of lock mandrel 50 uses an upwardly travelling inner mandrel 70. As shown, the lock mandrel 50 has the inner mandrel 70 located within a body 60 of the lock mandrel 50. The inner mandrel 70 can move between an upward position (as shown) and a downward position. In the upward position, a flange 72 on the inner mandrel 70 pushes lockout keys 78 outward to engage in a nipple profile (not shown).

In use, a running tool (not shown) holds the inner mandrel 70 down so the lockout keys 78 can retract within the main body 60. When run-in to a setting depth down the tubing string, the lock mandrel 50 stops against a no-go restriction in the tubing. Operators jar downwards to shear pins (not shown) on the setting tool, and fingers 74 on the inner mandrel disengage from a collet on the running tool. This releases the inner mandrel 70 to move upward by the bias of a spring 76, and the fingers 74 move out of a lower groove 62 in the body 60.

At this point, however, the lockout keys 78 are not in line with a profile in a landing nipple so the keys 78 cannot expand until the lock mandrel 50 has been lifted from the no-go. Accordingly, operators lift the lock mandrel 50 from the no-go restriction. When the keys 78 reach the landing nipple's profile, the inner mandrel 70 moves upward by the bias of spring 76 until the fingers 74 reach an upper groove 64. The flange 72 can then hold the expanded keys 78 in the nipple profile to support the lock mandrel 50. Operators then jar upwards on the running tool to shear it free from the set lock mandrel 50.

These two types of lock mandrels 10/50 have been used for many years. Yet, they still do not meet all of the challenges encountered in wells. Unfortunately, the lock mandrel 50 of FIG. 2 requires the use of a no-go restriction downhole to activate the mandrel 50. Using such a restriction may not always be available or preferred in a given implementation. In the lock mandrel 10 of FIGS. 1A-1B, friction from the upward-flowing fluids can push upward against the mandrel's inner components, which may be undesirable. For this reason, various retention features, such as shear pins or snap rings, have been used on this type of lock mandrel 10.

The subject matter of the present disclosure is directed to overcoming, or at least reducing the effects of, one or more of the problems set forth above.

SUMMARY

Selective and non-selective lock mandrel assemblies disclosed herein overcome problems caused by upward flow tending to open the lock mandrel. In the disclosed assemblies, the lock mandrel has a spring loaded, upward moving inner mandrel. Upward flow in the lock mandrel acts to set the inner mandrel further rather than unset it. In this way, the inner mandrel can better hold the keys locked in a landing nipple profile.

In one arrangement, the lock mandrel is non-selective and sets in the first existing nipple profile encountered during run-in. In another arrangement, the lock mandrel is selective and can be selectively set in an existing nipple profile as desired. Thus, this selective arrangement allows multiple nipples with the same minimum internal diameter to be used downhole rather than requiring a tapered completion. Because the disclosed assemblies can be used in existing landing nipples, there is no need to design nipple profiles.

In the non-selective arrangement, a housing of a lock mandrel affixes to a running tool using shear pins. Installed in the lock mandrel, the running tool has a collet that holds an inner mandrel in a downhole position within the housing. Operators run in the lock mandrel with the running tool downhole. Being non-selective, a biased key on the lock mandrel moves to an extended condition when reaching a landing nipple profile. At this point, a downhole-facing shoulder on the biased key engages against an uphole-facing shoulder of the landing nipple profile to stop further run-in of the lock mandrel.

With the mandrel landed, operators shear a first shear pin on the running tool by jarring downhole. This allows portion of the running tool to move the collet and release its hold on the inner mandrel. Consequently, the inner mandrel biased by a spring moves to an uphole position in the housing, and a flange on the inner mandrel fits behind the extended key to lock it in the landing nipple profile. Finally, operators shear a second shear pin on the running tool by jarring uphole on the running tool so that the running tool can be retrieved from the lock mandrel set in the landing nipple.

In the selective arrangement, the housing of the lock mandrel has a fishing neck in which fishing neck dogs of the running tool engage to hold the lock mandrel during run-in. As before, a collet on the running tool holds the inner mandrel in the downhole position. For selective operation, a portion of the lock mandrel temporarily holds the key in a retracted condition, which allows the lock mandrel to be run through various landing nipples.

To install the lock mandrel in a desired landing nipple, operators run in the lock mandrel until the key passes the landing nipple profile and locator dogs pass a transition. By then running up the lock mandrel with the running tool, the spring biased locator dogs on the running tool engage the transition, and the running tool is shifted to a non-selective condition with further movement upward. For example, when the dogs engage the transition, the inner mandrel held by the tool's collet shifts slightly and releases its hold on the biased key of the lock mandrel.

Once released, the biased key can move toward its extended condition, although the surrounding wall of the landing nipple may prevent it. With the biased key downhole from the nipple profile, operators continue running the lock mandrel uphole until the biased key passes the profile. Once the key is above the profile, operators then run in the lock mandrel again and engage the biased key against the profile. At this point, a downhole-facing shoulder on the biased key engages against an uphole-facing shoulder of the landing nipple profile to stop further run-in of the lock mandrel.

Operators shear a shear pin on the running tool by jarring downhole. This allows of the collet on the running tool to move and release its hold on the inner mandrel. The released inner mandrel biased by a spring moves to an uphole position in the housing. When moved uphole, a flange on the inner mandrel fits behind the extended key and locks it in the landing nipple profile. Freed due to the shearing, the core moves down, and a groove on the core reaches the fishing neck dog on the outer sleeve. The fishing neck dog then disengages from the fishing neck by retracting into the groove. At this point, operators pull up on the running tool to remove the retracted fishing neck dog from the tool's fishing neck and retrieve the running tool to surface.

The foregoing summary is not intended to summarize each potential embodiment or every aspect of the present disclosure.

DETAILED DESCRIPTION

A. Non-Selective Assembly

Figure 1A:
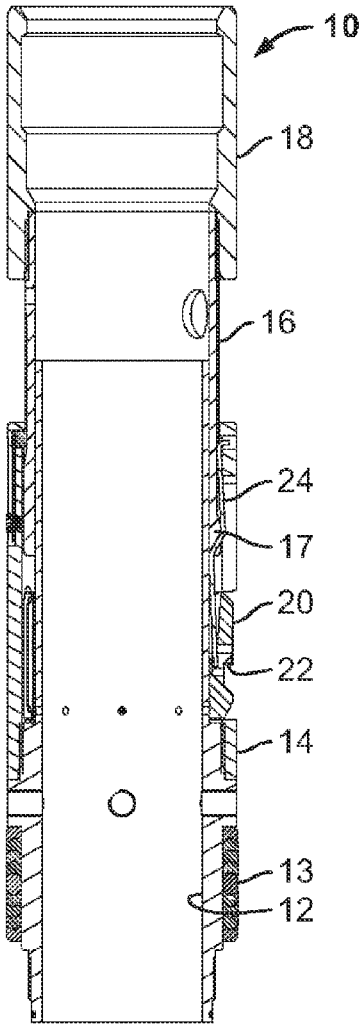
FIG. 1A (Prior Art)
FIGS. 1A-1B show a lock mandrel according to the prior art in unlocked and locked conditions.
Figure 1B:
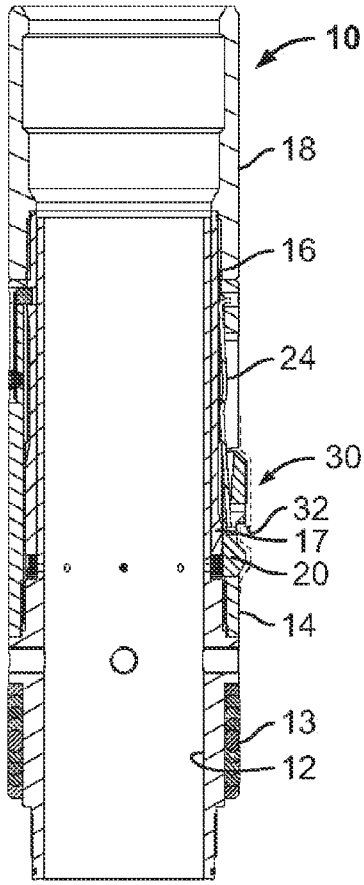
FIG. 1B (Prior Art)
Figure 2:
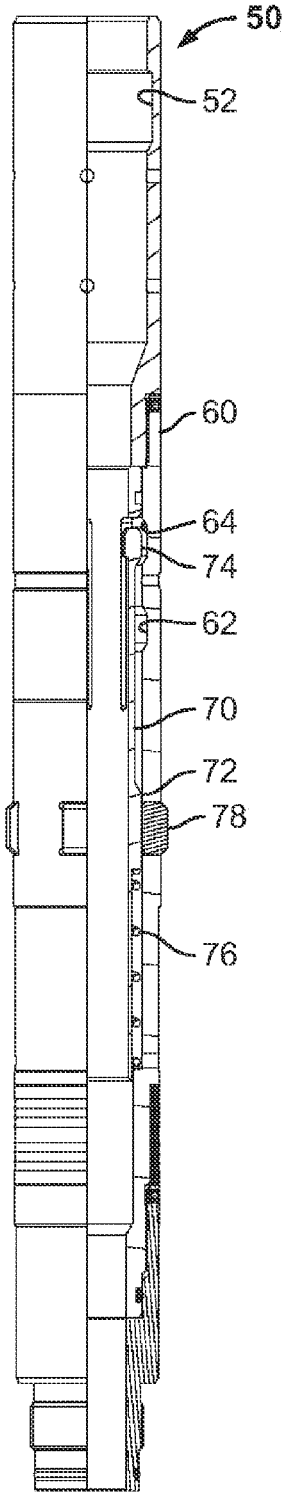
FIG. 2 (Prior Art)
FIG. 2 is a cross-sectional view of another lock mandrel according to the prior art.
Figure 3A:
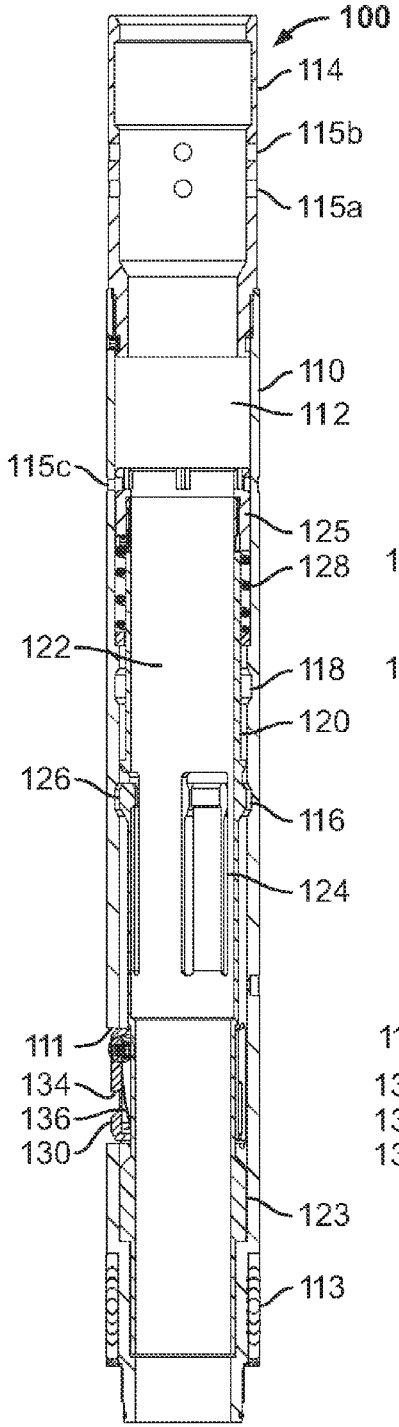
FIGS. 3A-3B are cross-sectional views of a lock mandrel for a non-selective assembly according to the present disclosure in a run-in and a set condition.
Figure 3B:
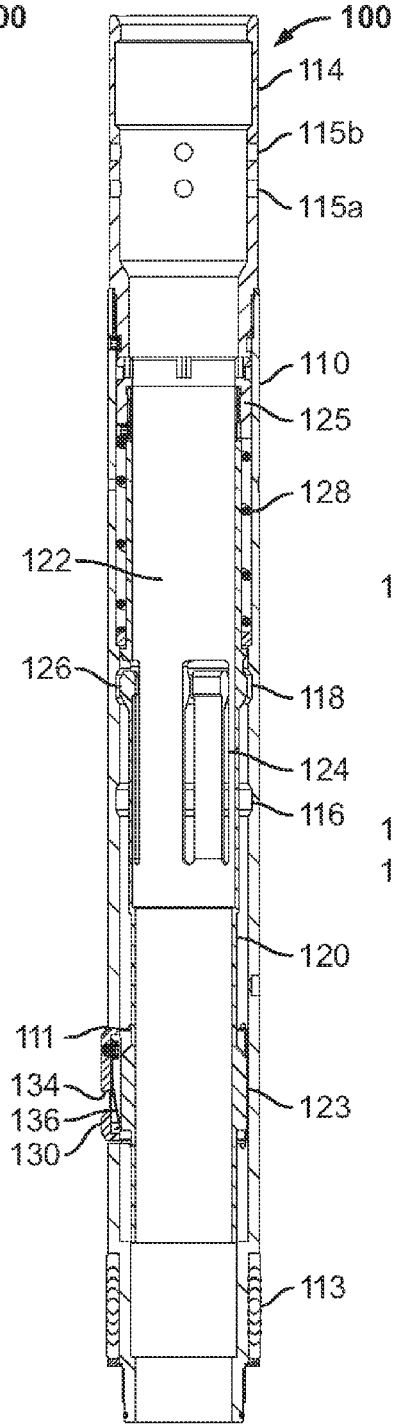
Figure 3C:
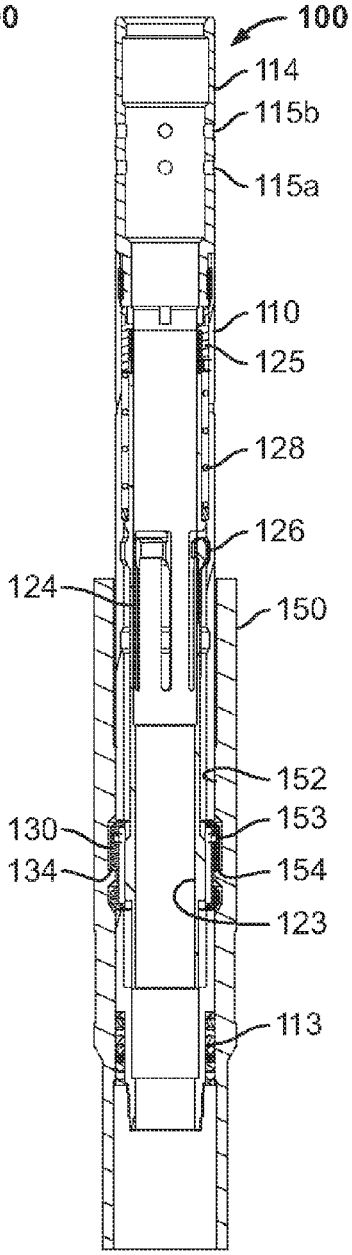
FIG. 3C shows the lock mandrel of FIGS. 3A-3B landed in a landing nipple.
Figure 4:
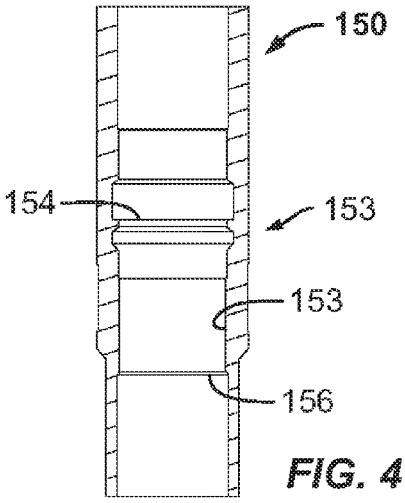
FIG. 4 is a cross-sectional view of a landing nipple for the disclosed lock mandrel.
Figure 5:
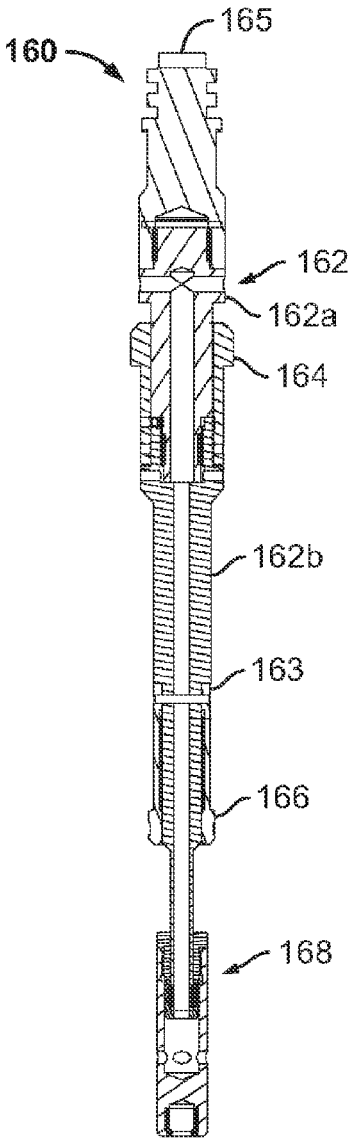
FIG. 5 is a cross-sectional view of a running tool for the non-selective lock mandrel assembly.
Figure 6:
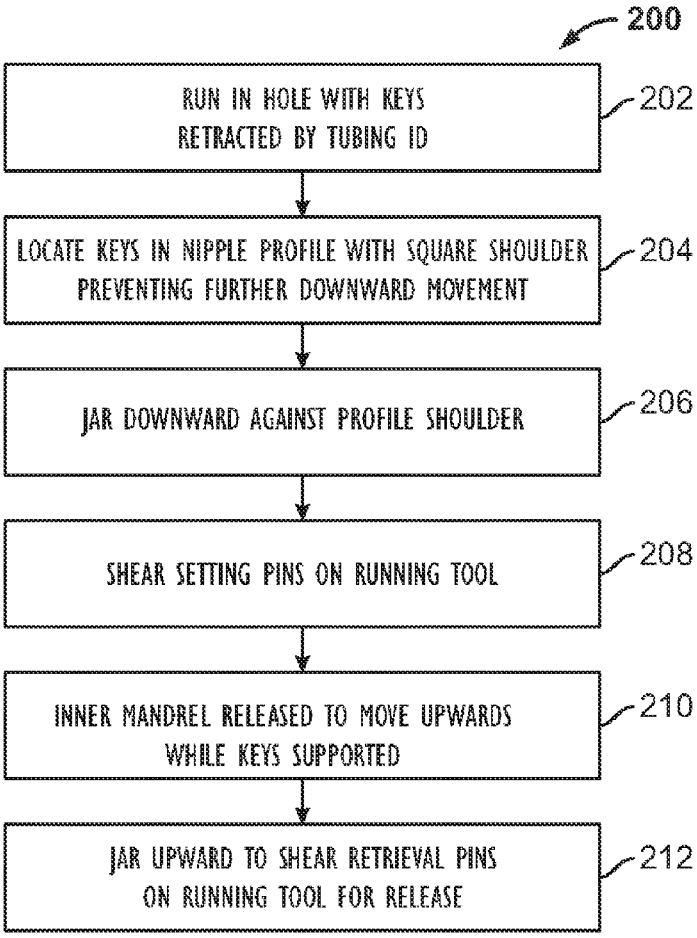
FIG. 6 is a process for running in the non-selective lock mandrel assembly.

Referring to FIGS. 3A through 7D, a non-selective lock mandrel assembly 80 according to certain teachings of the present disclosure includes a lock mandrel 100 (FIGS. 3A-3B) and a running tool 160 (FIG. 5). The running tool 160 is used to run-in the lock mandrel 100 and set it in a landing nipple 150 (FIG. 4).

1. Lock Mandrel and Running Tool

The lock mandrel 100 illustrated in FIGS. 3A-3B has a tubular housing 110 with a fishing neck 114 attached on its uphole end. An inner mandrel 120 disposes in the housing's bore 112, and the bias of a spring 128 can move the inner mandrel 120 in the bore 112. Inner fingers 124 on the mandrel 120 have heads 126 that dispose partially in the mandrel's bore 122 and partially in grooves 116/118 on the body's bore 112.

One or more biased keys 130 fit in windows 111 in the housing 110 and can move between a retracted condition (FIG. 3A) and extended condition (FIG. 3B) by the movement of the inner mandrel 120. Preferably, the lock mandrel 100 uses several such biased keys 130 disposed about its circumference. To bias the key, a spring 136 affixed to the inside of the key 130 biases the key 130 away from the mandrel 120.

When the mandrel 120 positions downward in the lock mandrel's housing 110 as shown in FIG. 3A, a flange or lip 123 on the end of the mandrel 120 is moved away from the keys 130. This permits the keys 130 to retract in the windows 111 against the smaller diameter waist of the inner mandrel 120 as a surrounding wall of a tubular or the like (not shown) pushes against the bias of the spring 136. When the mandrel 120 positions upward in the lock mandrel's housing 110 as shown in FIG. 3B, however, the flange 123 on the end of the mandrel 120 is moved behind the keys 130. This pushes the keys 130 to an extended condition in the windows 111. Further details of the lock mandrel 100 are discussed below with reference to its deployment and retrieval.

Figure 7A:
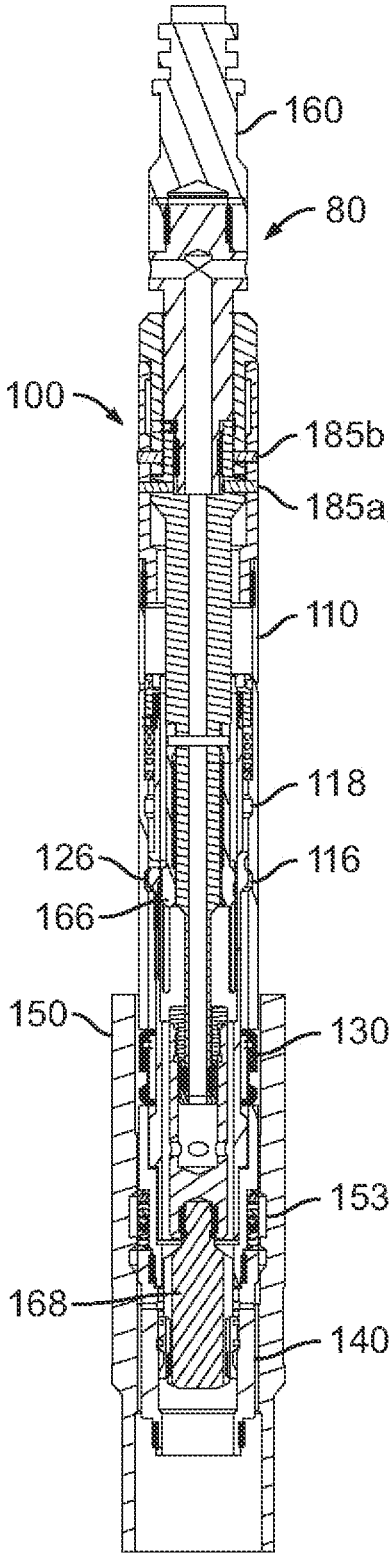
FIGS. 7A-7D show the non-selective lock mandrel assembly during run-in procedures.

As shown in FIG. 3C, the lock mandrel 100 installs in a landing nipple 150 disposed downhole on a tubing string (not shown). The lock mandrel 100 can be used to support any number of flow control devices in the tubing. Although not shown in FIG. 3C, the flow control devices can include an equalizing assembly (See e.g., 140; FIG. 7A), pump-open plug, flow sub, test/blank caps, etc.

Shown in isolation in FIG. 4, the landing nipple 150 defines an inner bore 152 with a profile 153 for locking the lock mandrel (100) therein. As shown, this profile 153 is an X® profile. (X® is a registered trademark of Halliburton Energy Services, Inc.) Further details of the landing nipple 150 are discussed below with reference to the run-in procedure. For its part, the running tool 160 shown in FIG. 5 runs the disclosed lock mandrel (100) in the landing nipple (150). Further details of the running tool 160 are provided below with reference to the deployment of the disclosed lock mandrel.

2. Run-in Procedure

Turning now to the run-in procedure, the lock mandrel 100 is first prepared and affixed to the running tool 160. Initially, the inner mandrel 120 is cocked inside the housing 110. For example, operators insert a punch (not shown) into a punch hole 115*c* in the housing 110 as shown in FIG. 3A. Once inserted, this punch in the hole 115*c* can engage the end cap 125 and hold the inner mandrel 120 in place in the housing 110.

Once the inner mandrel 120 is cocked and held by the punch, the running tool 160 and accessories are made up to the lock mandrel 100. (FIG. 7A shows the assembly 80 having the lock mandrel 100, equalizing assembly 140, and running tool 160 being made up together.) In this example, the running tool 160 includes a running prong 168 for engaging the equalizing assembly 140 when installed on the lock mandrel 100, but this depends on the accessory used and is not necessary in a given implementation.

While holding the tool's shear sleeve 164 in place, operators pull the top sub 162*a* up until a groove aligns with the top of the shear sleeve 164 indicating proper positioning. At this point, operators insert shear pins 185*a-b* in the fishing neck 114 and tool 160. In particular, two sets of longitudinally spaced shear pins 185*a-b* insert through co-axial openings 115*a-b* in the fishing neck 114 and into a shear off sub portion of the running tool 160. As shown in FIG. 7A, a first setting pin 185*a* locks a main stem 162 of the tool 160 inside the fishing neck 114, and a second retrieval pin 186*b* locks the sleeve 164 of the tool 160 to the fishing neck 114. The setting pin 185*a* is intended to shear on a downward jar, whereas the retrieval pin 185*b* is intended to shear on an upward jar and can have greater shear strength.

With the shear pins 185*a-b* inserted, the running tool 160 is now affixed to the mandrel 100 so the punch can be removed from punch hole 115*c*. Although the inner mandrel 120 can move up slightly, it is held by the mandrel's fingers 124 and the tool's collet 166. As shown in FIG. 7A, the downward-extending fingers on the tool's collet 166 engage the upward-extending fingers 124 on the inner mandrel 120. As a result, the heads 126 of the mandrel's fingers 124 fit into the lower surrounding groove 116 in the body's bore 112, keeping the inner mandrel 120 in its downward position.

With the nipple 150 already installed downhole and the lock mandrel 100 attached to the running tool 160 as described above, operators now commence with the run-in procedures outlined in FIGS. 6 and 7A-7D. At this point, operators deploy the lock mandrel 100 into the wellbore using the running tool 160 and wireline or similar procedures known in the art (Block 202). As shown in FIG. 7A, the surrounding sidewall holds the biased keys 130 in their retracted condition. Yet, for this non-selective mandrel 100, the biased keys 130 will locate in the first nipple profile 153 that they meet downhole.

Figure 7B:
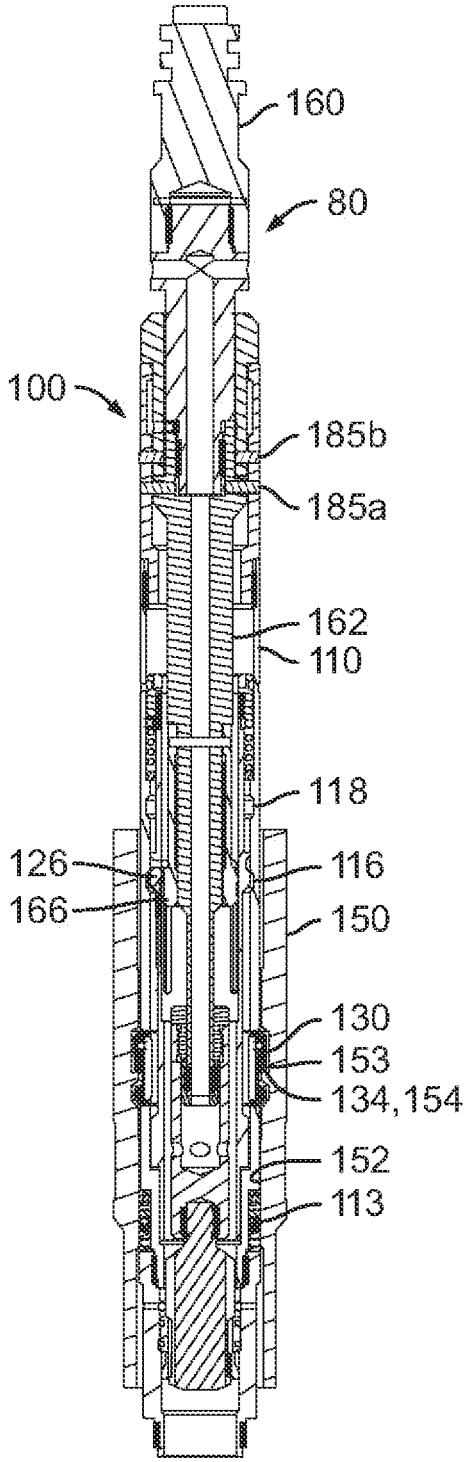

Eventually, the lock mandrel 100 reaches the landing nipple 150, and the packing seal 113 disposed around the housing 110 passes the nipple profile 153 and engages the polished bore 152. At this point, the keys 130 biased outward by springs 136 locate in the nipple profile 153 as shown in FIG. 7B. The square shoulders 134/154 between the keys 130 and profile 153 prevent further downward movement of the lock mandrel 100 (Block 204).

Figure 7C:
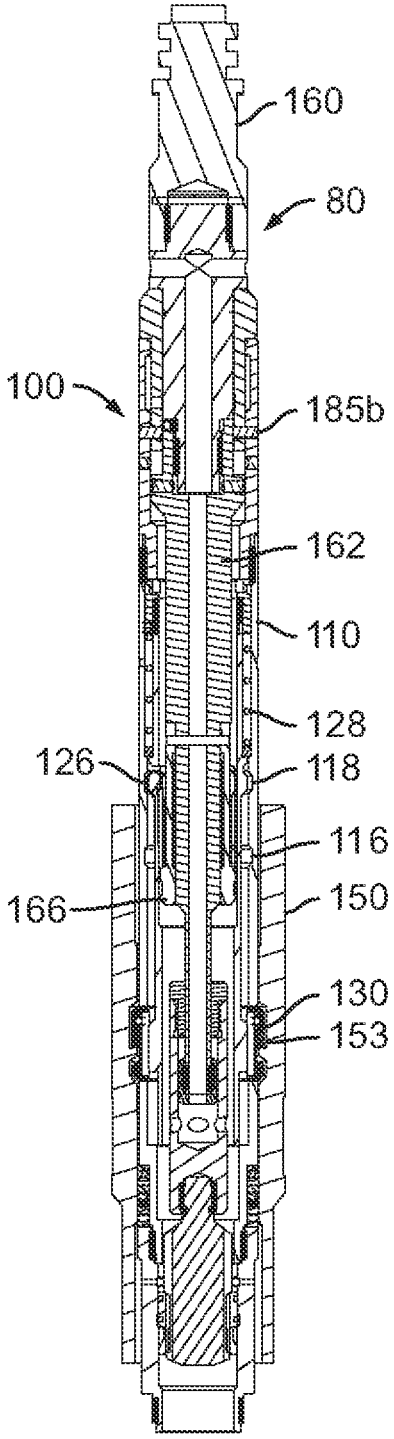

Operators then jar downwards on the running tool 160 while the keys 130 hold the lock mandrel 100 in the profile 153 (Block 206). The jarring shears the setting pins 185*a* that hold the running tool's core 162 to the fishing neck 114 (Block 208). As shown in FIG. 7C, the running tool's core 162 can move further downward in the main housing 110.

As the setting pins 185*a* shear, the collet 166 moves with the core 162 away from the mandrel's fingers 124. Released, the inner mandrel 120 moves upward by the bias of the spring 128, and the heads of the mandrel's fingers 124 move into the upper surrounding groove 118 (Block 210). Meanwhile, the keys 130 remain supported in the profile 156, and the mandrel's lower flange 123 eventually fits behind the extended keys 130 to hold the keys 130 in their extended condition engaged in the profile 156.

Figure 7D:
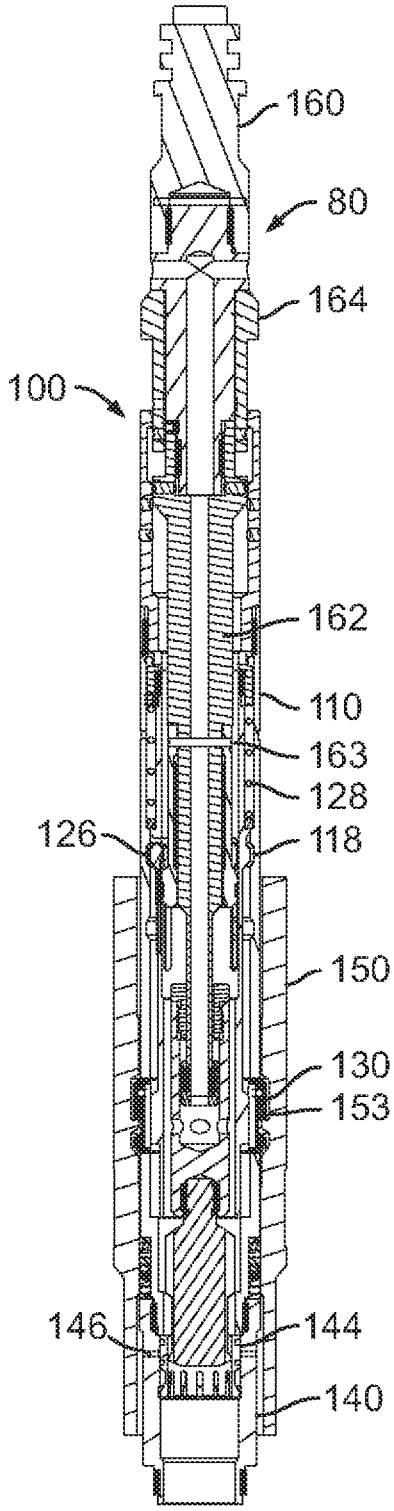

Operators at this stage can perform a check pull to ensure proper locking. With this pull, the running tool 160 reverts to its pre-sheared position. Finally, operators jar upward to shear the retrieval pins 185*b* on the running tool 160 (Block 212). This releases the tool's sleeve 164 from the fishing neck 114 as shown in FIG. 7D and allows the tool 160 to be removed from the locked mandrel 100 and retrieved at the surface. When moving out of the mandrel 100, the setting prong 168 on the tool 160 pulls up equalizing melon 144 to seal the equalizing ports 146.

Once the tool 160 is removed, any flow of produced fluid from the well that may act against the inner mandrel 120 will generally tend to move the inner mandrel 120 more in its locking direction. In addition, as the tool 160 is pulled from the mandrel 100, the downward-extending fingers of the telltale collet 166 on the tool 160 pass under the mandrel's fingers 124. As long as the inner mandrel 120 has properly moved, a telltale shear pin 163 (FIGS. 5 & 7D) should not be sheared when operators check the running tool 160 at surface. If the finger's ends 126 do not correctly engage in the upper groove 118 when the running tool 160 is withdrawn, for example, then the fingers 124 restrict the collet 166 and cause the shear pin 163 to shear before the collet 166 can pass. At the surface, operators can note the broken shear pin 163 as indicating the lock mandrel 100 as not being properly set.

B. Selective Assembly

Figure 8:
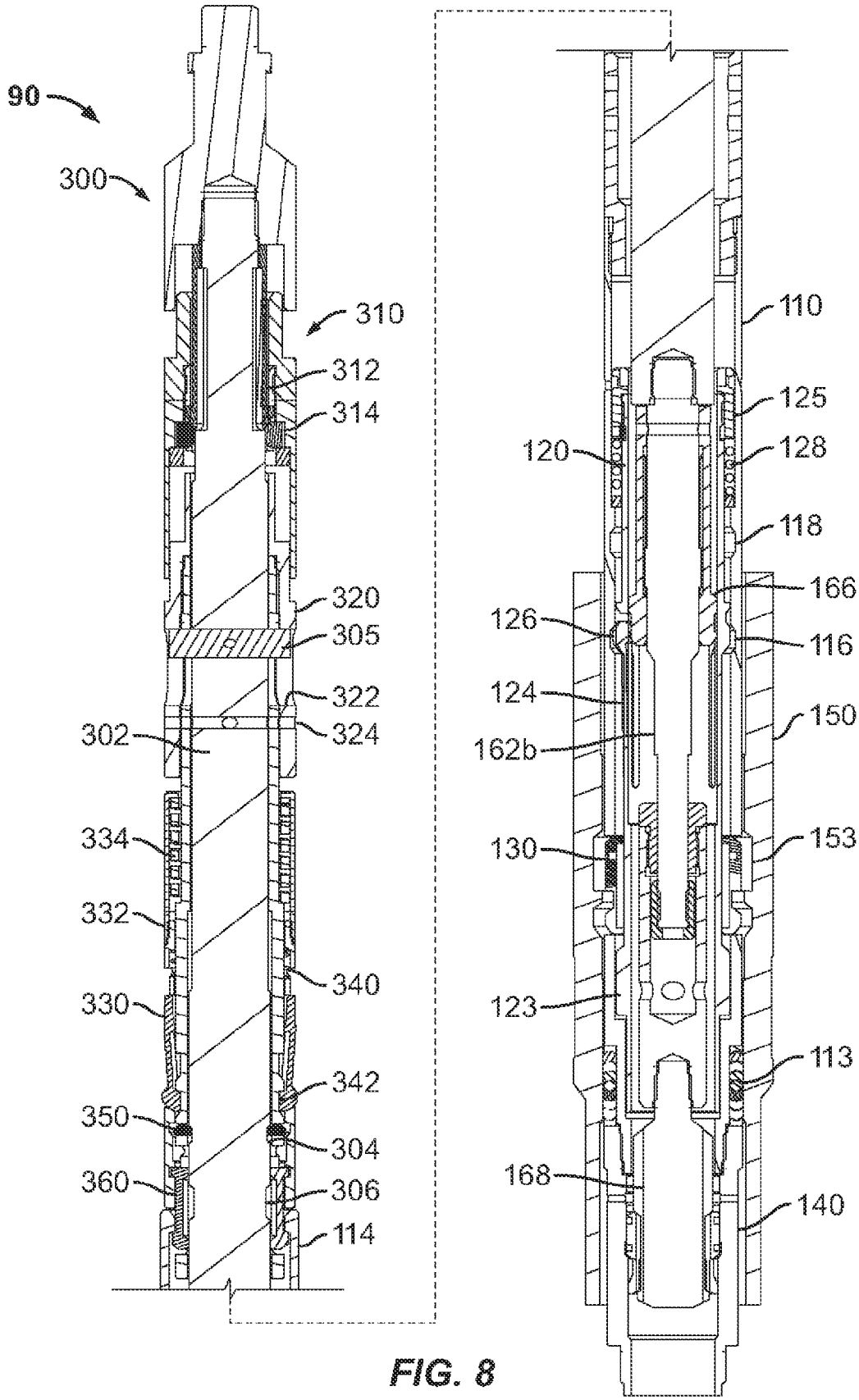
FIG. 8 is a cross-sectional view of a selective lock mandrel assembly and running tool according to the present disclosure.

The lock mandrel assembly 80 discussed above is non-selective, meaning that the spring biased keys 130 on the lock mandrel 100 will engage the first landing nipple profile 153 encountered during run-in. An alternative lock mandrel assembly 90 in FIG. 8 is selective and can be passed through any desired number of landing nipples until activated. This selective lock mandrel assembly 90 includes the lock mandrel 100 similar to that discussed previously and includes a running tool 300. The running tool 300 is used to run the lock mandrel 100 downhole to be selectively set in a landing nipple 150.

1. Lock Mandrel and Running Tool

As shown in FIG. 8, the lock mandrel 100 (shown with the running tool 300 installed) has many of the same components as previously described so that like reference numerals are used for like components. The running tool 300, however, includes a core 302 having a top latch 310, a coupling head 320, locator dogs 330, an inner sleeve 340, a catch dog 350, and fishing neck dogs 360 disposed thereon.

In general, the coupling head 320 and inner sleeve 340 are held to the core 302 by a shear pin 324 and a guide pin 305 in slots 322 that limits the relative travel therebetween when the pin 324 is sheared. The locator dogs 330 moves with an outer sleeve 332 through the bias of a spring 334 relative to a groove 342 on the inner sleeve 340. Likewise, grooves 304/306 on the core 302 move relative to the lock dog 350 and locator dogs 360, respectively, when the core 302 is moved. Further details of the running tool 300 are provided below.

Figure 9:
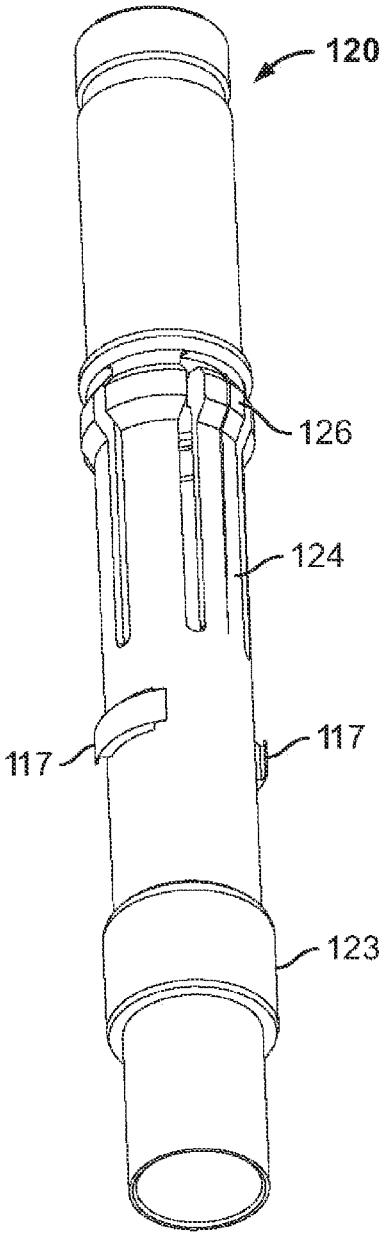
FIG. 9 shows a perspective view of an inner mandrel for the selective lock mandrel assembly.
Figure 10:
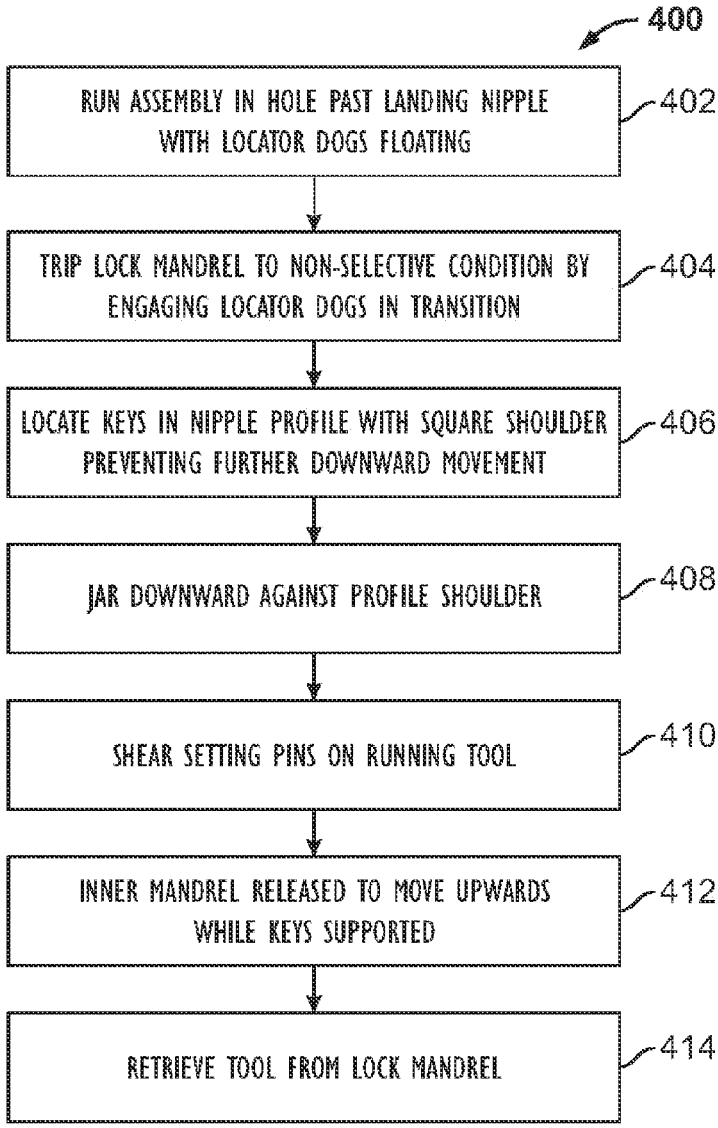
FIG. 10 is a process for running-in the selective lock mandrel assembly of FIG. 8.

On the lock mandrel 100 itself, the inner mandrel 120 has lock features to hold the keys 130 in a retracted position, as the mandrel 100 is run downhole until activated. FIG. 9 shows a perspective view of an inner mandrel 120 for the selective lock mandrel 100. Between the upward fingers 124 and flange 123, this mandrel 120 includes ledges or catches 117 disposed on the outside. These catches 117 can hold the keys (130) temporarily against the inner mandrel 120 in a retracted condition for run-in. Once the inner mandrel 120 is moved slightly, these catches 117 release their hold on the keys (130) so they can be biased to an extended position, as described in more detail below.

2. Run-in Procedure

Figure 11A:
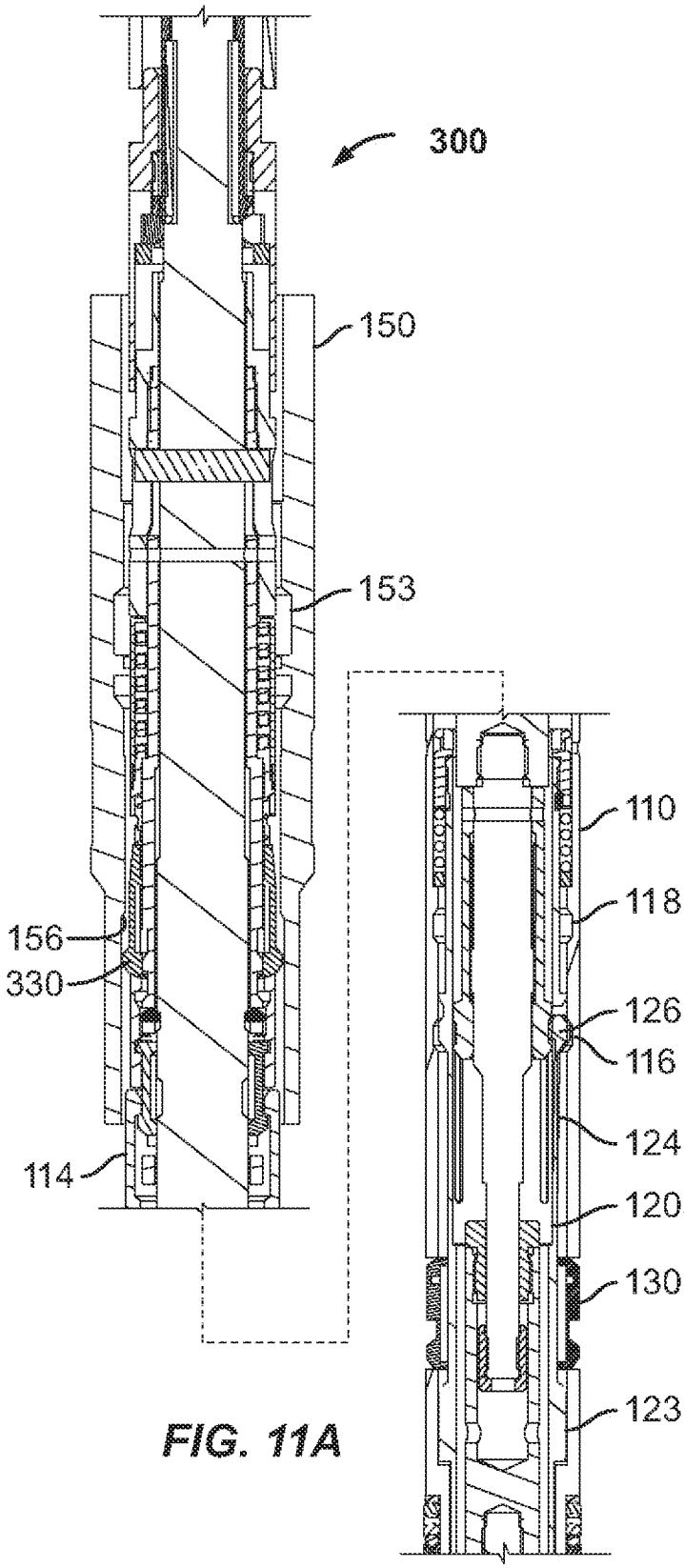
FIGS. 11A-11F show the selective lock mandrel assembly during run-in procedures with the running tool.

With an understanding of the selective lock mandrel assembly 90 of FIG. 8, discussion now turns to a run-in procedure as shown in FIGS. 10 and 11A-11F. Initially, the running tool 300, lock mandrel 100, and accessory 140 are made up as described previously. Then, operators run in the assembly 90 with the tool's locator dogs 330 floating and with the mandrel's keys 130 retracted (Block 402). On the lock mandrel 100, the keys 130 are held in a retracted condition by the catches (117; FIG. 9) on the inner mandrel 120. As shown in FIG. 11A, the floating dogs 330 and the retracted keys 130 allow the running tool 300 and lock mandrel 100 to pass through as many landing nipples 150 as desired.

Figure 11B:
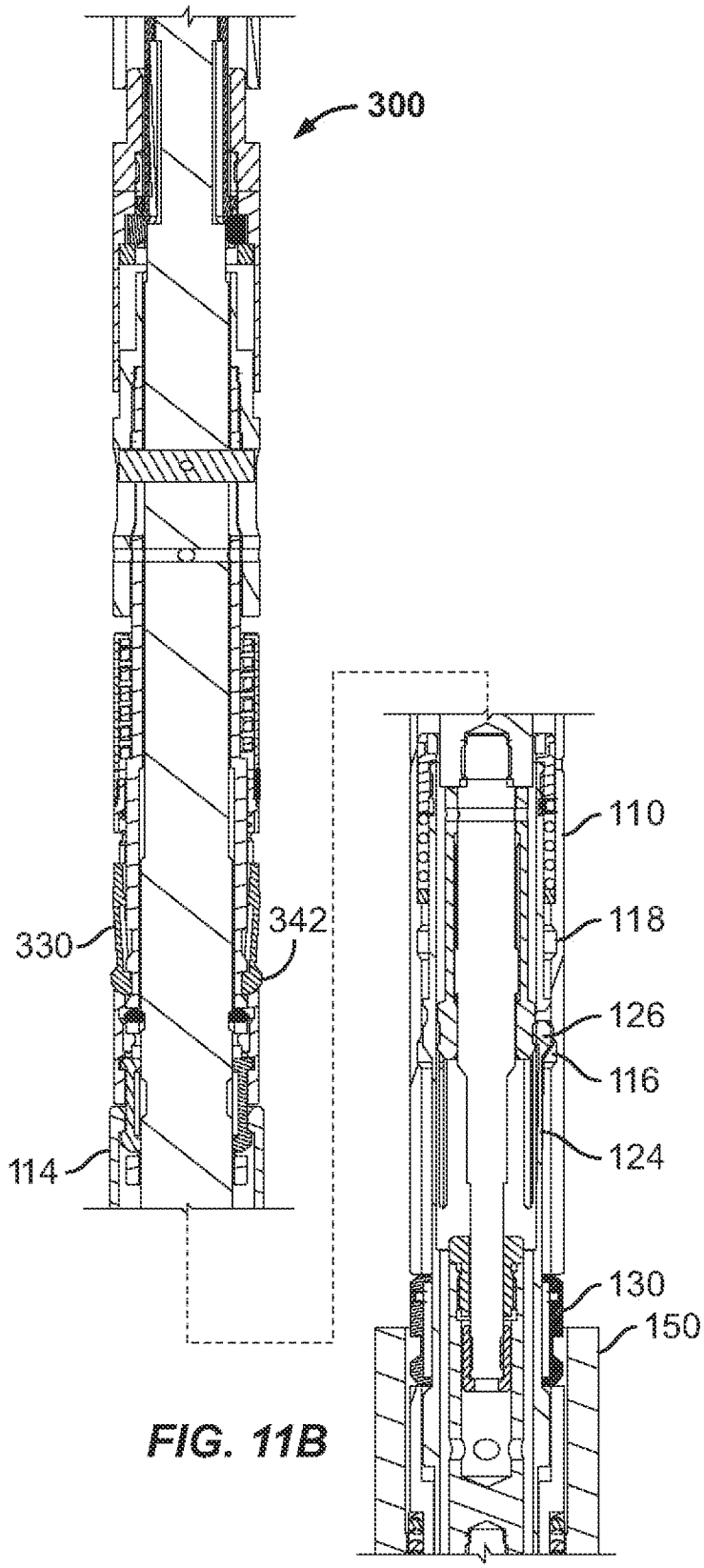

Operators pass the tool 300 through the desired nipple 150 as shown in FIG. 11A. After passing through, operators then run the tool 300 and mandrel 100 up hole until the floating locator dogs 330 contact the connecting transition 156 on the nipple 150 (Block 404). This trips the lock mandrel 100 to a non-selective condition as shown in FIG. 11B. The inner mandrel 120 is pulled up slightly with the running tool core 302, while the mandrel's housing 110 remains fixed by the locator dogs 330. As a result, the locator dogs 330 fit into grooves 342. Yet, the heads 126 on the mandrel's fingers 124 move slightly out of the surrounding groove 116 in the housing 110. This movement of the inner mandrel 120 disengages the catches (117; FIG. 9) on the inner mandrel 120 from their hold on the keys 130. As a result, the spring-biased keys 130 can expand outward, but are held by the surrounding tubular wall.

Figure 11C:
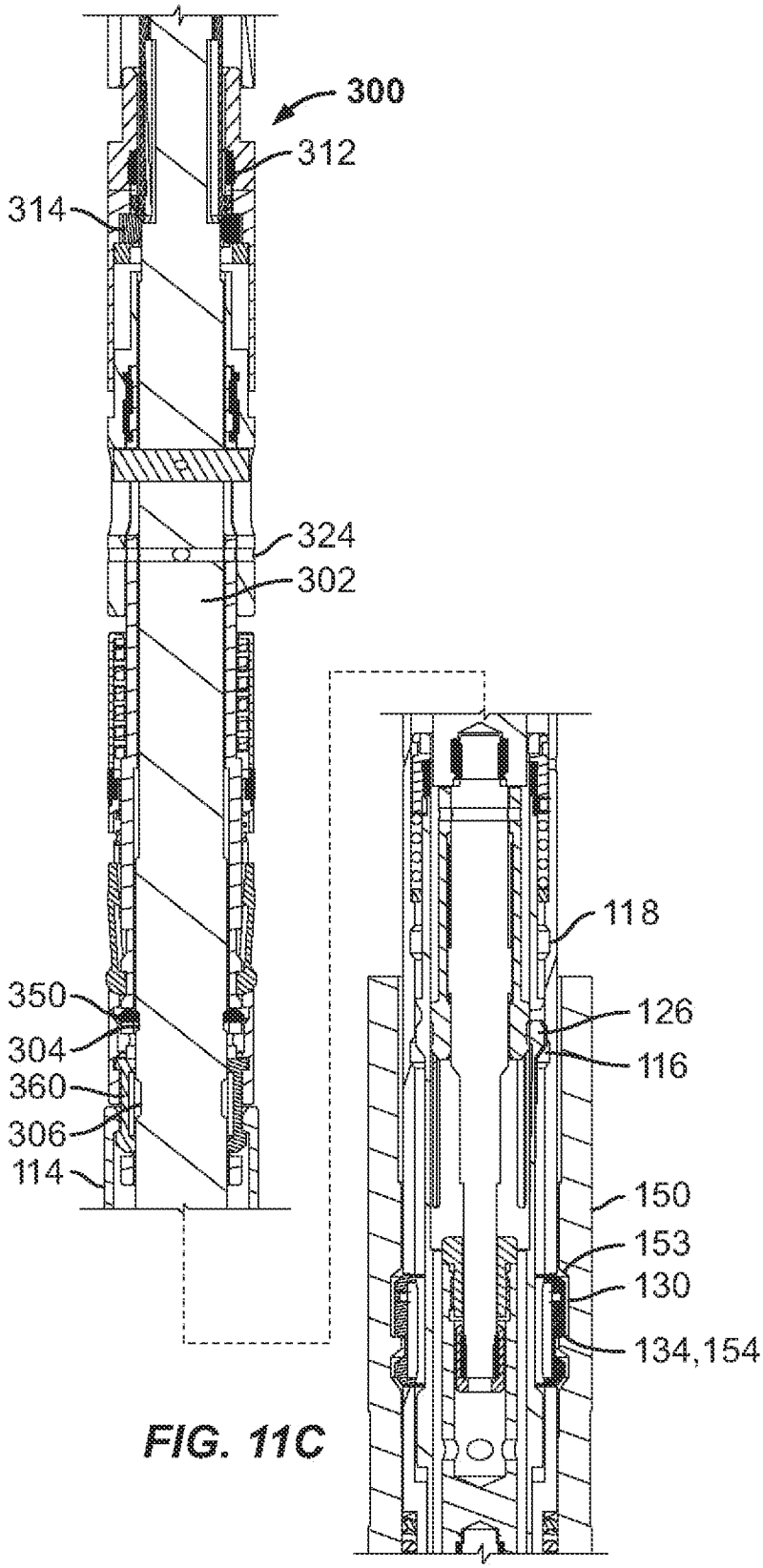

Operators continue lifting the lock mandrel 100 until the keys 130 pass uphole of the profile 153 as shown in FIG. 11B. At this point, operators run-in the assembly 90, and the keys 130 locate in the nipple profile 153 as shown in FIG. 11C (Block 406). As before, the engagement of the square shoulders 134/154 between the keys 130 and profile 153 prevents further downward movement of the lock mandrel 100.

Figure 11D:
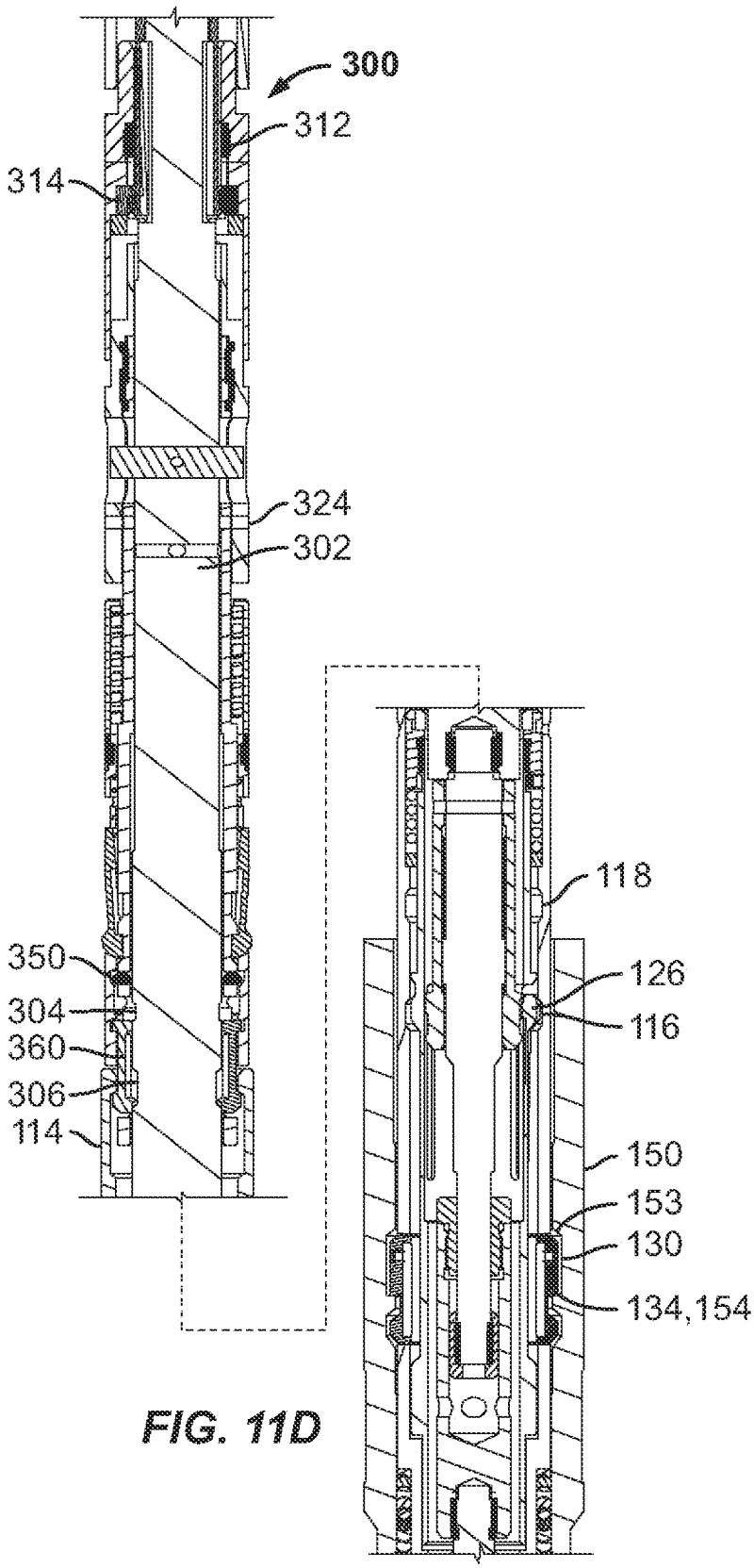

Operators then jar downward on the assembly 90 (Block 408) and break the shear pin 324 that holds the running tool's core 302 to the coupling head 320 as shown in FIG. 11D (Block 410). With the core 302 sheared free, it can travel further downhole as the guide pin 305 travels in the guide slot 322 of the coupling head 320. The top collet 312 moves past top catch 314 as the core 302 shifts downward. In turn, the downward moving core 302 shifts its upper groove 304 away from holding dog 350 and shifts lower groove 306 toward the fishing neck dogs 360 connected to the mandrel's fishing neck 114 as shown in FIG. 11D.

Figure 11E:
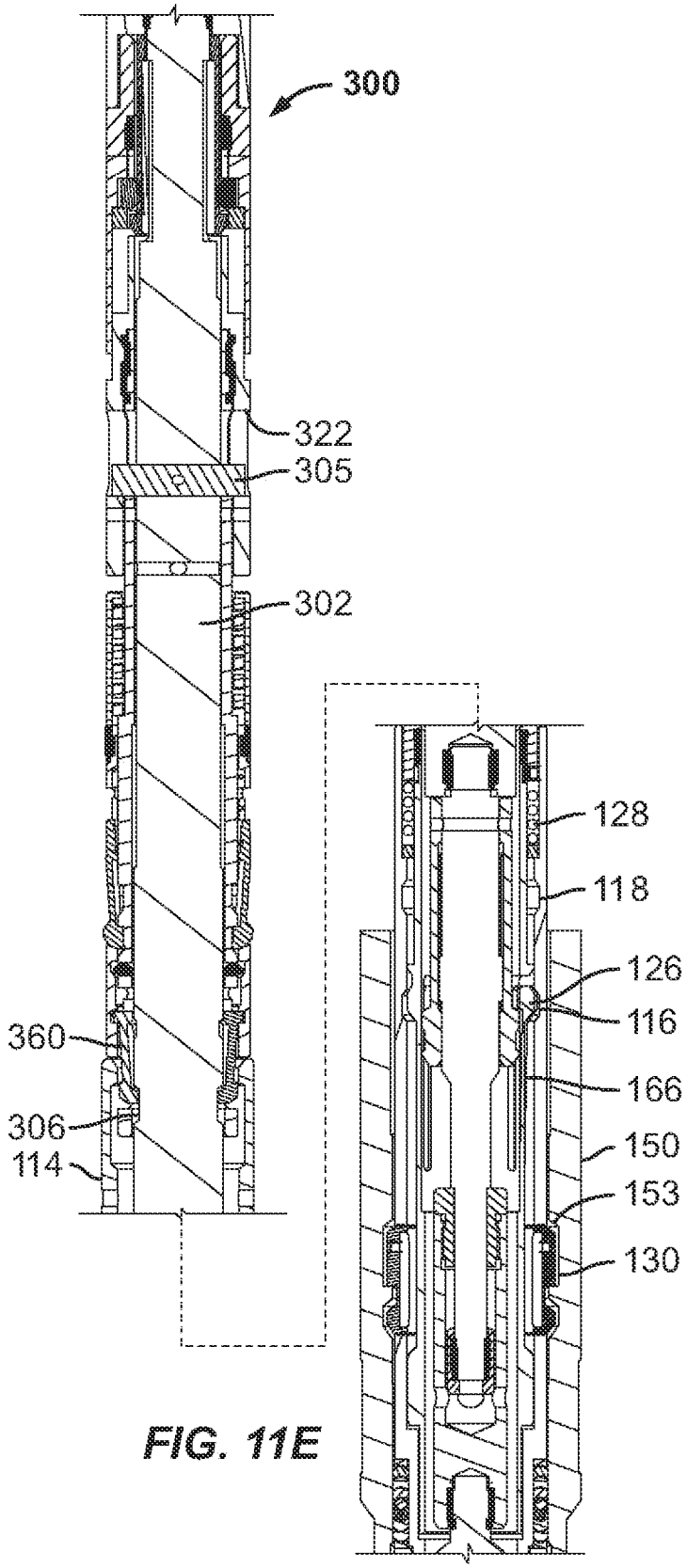
Figure 11F:
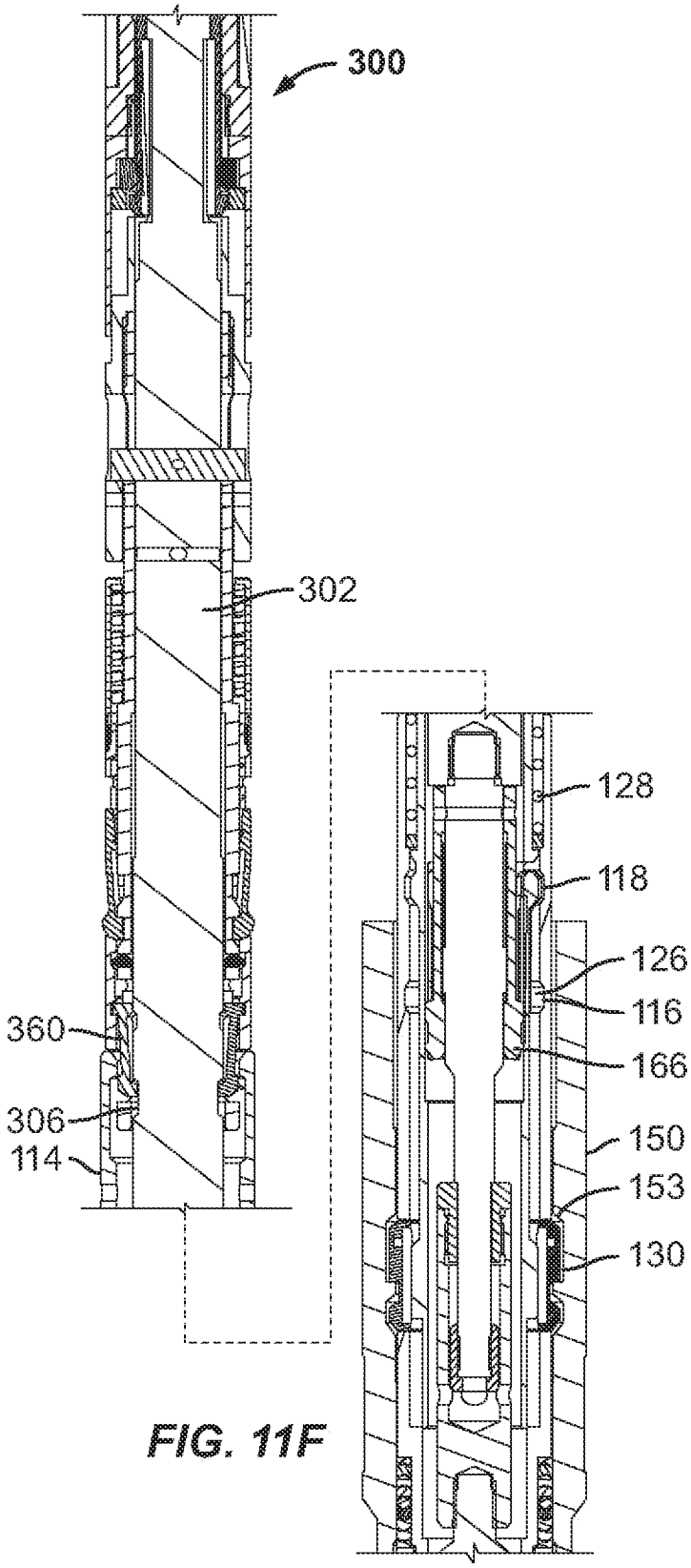

As the running tool 300 is run further in hole, the core 302 moves further into the mandrel 310, and the telltale collet 166 on the tool 300 frees its support of the inner mandrel's fingers 124 as shown in FIG. 11E. Consequently, the mandrel 120 is free to move up by the bias of the spring 128 as noted previously (Block 412). The lock mandrel 100 is now set in the nipple 150 with the keys 130 locked into the profile 153 as shown in FIG. 11F.

At this point, the running tool 300 can now be detached from the lock mandrel 100 and retrieved (Block 414). The tool's dogs 360 fit into the core's lower groove 306 and are free from engagement with the fishing neck 114 on the mandrel's housing 110 as the tool 300 is removed.

In the current arrangement, the transition 156 for engaging the locator dogs 330 is disposed on the landing nipple 150 below the profile 153 as shown in FIG. 11A. This requires that the keys 130 be run-in past the profile 153 in which it is to be set because the locator dogs 330 are situated uphole from the keys 130. Other arrangements could also be used if desired.

C. Retrieval Procedure

Figure 12:
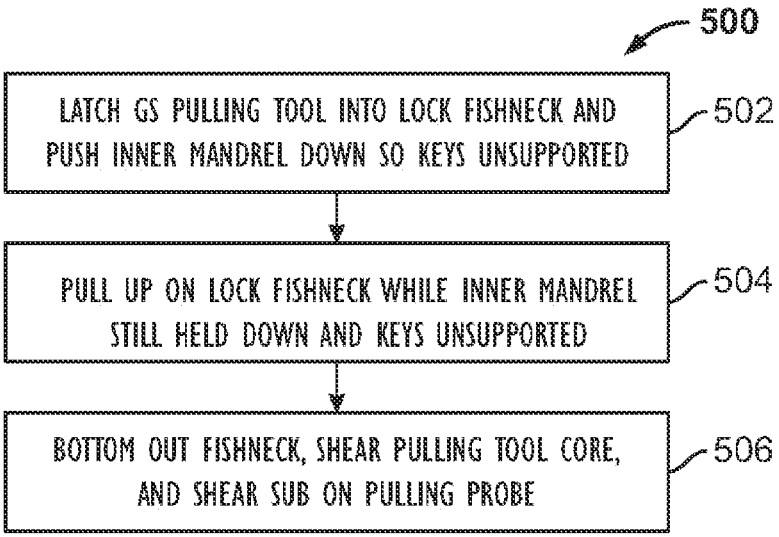
FIG. 12 is a process for retrieving the disclosed lock mandrel.

After the lock mandrel 100 has been deployed, operators may retrieve the mandrel 100 and its attached flow accessory 140 when desired. A process 500 for retrieving the lock mandrel 100 is shown in FIG. 12. For its part, FIG. 13 shows a retrieval tool 170 for the disclosed lock mandrel (100), and FIGS. 14A-14C show the lock mandrel 100 during retrieval procedures with the retrieval tool 170.

Figure 13:
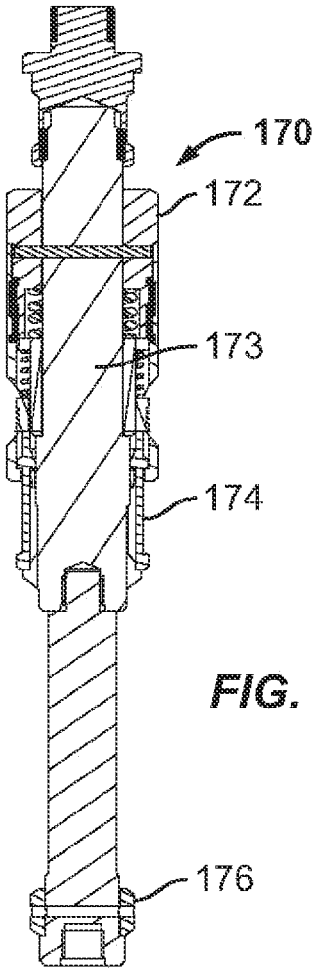
FIG. 13 is a cross-sectional view of a retrieval tool for the disclosed lock mandrel.

As shown in FIG. 13, the retrieval tool 170 can be a standard GS type wireline pulling tool having a coupling 172 shear pinned to a core 173. The tool's dogs 174 disposed about the core 173 can engage fishing necks used on downhole tools. An intermediate collar 176 is also disposed on the core 173, and an equalizing prong (178; FIG. 14A) can extend from the end of the core 173 if needed.

Figure 14A:
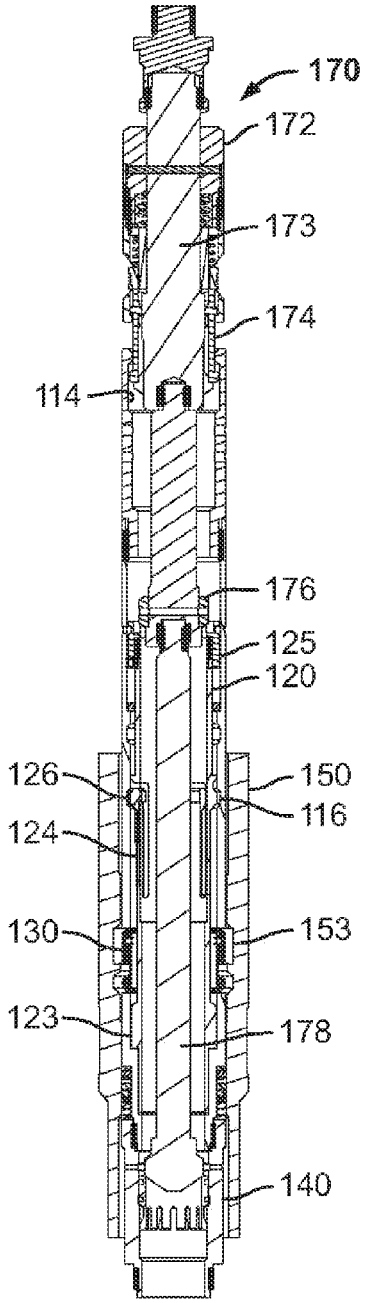
FIGS. 14A-14C show the disclosed lock mandrel during retrieval procedures with the retrieval tool.
Figure 14B:
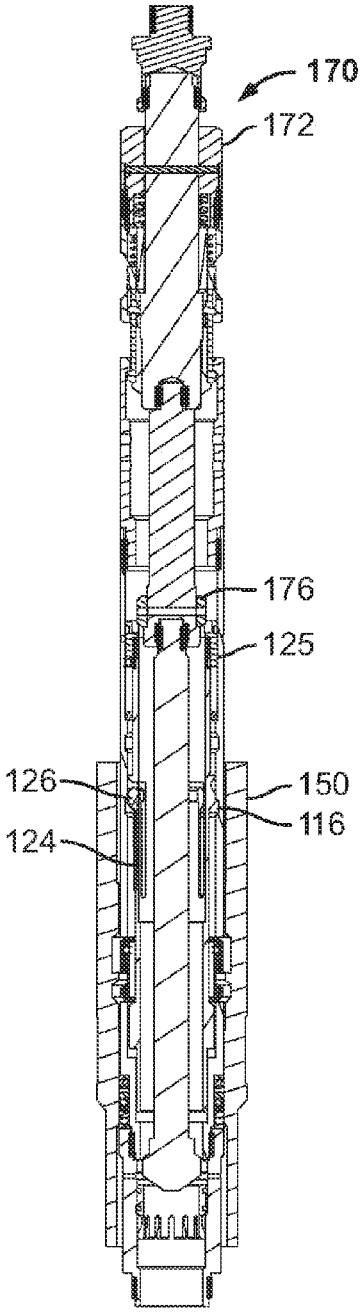
Figure 14C:
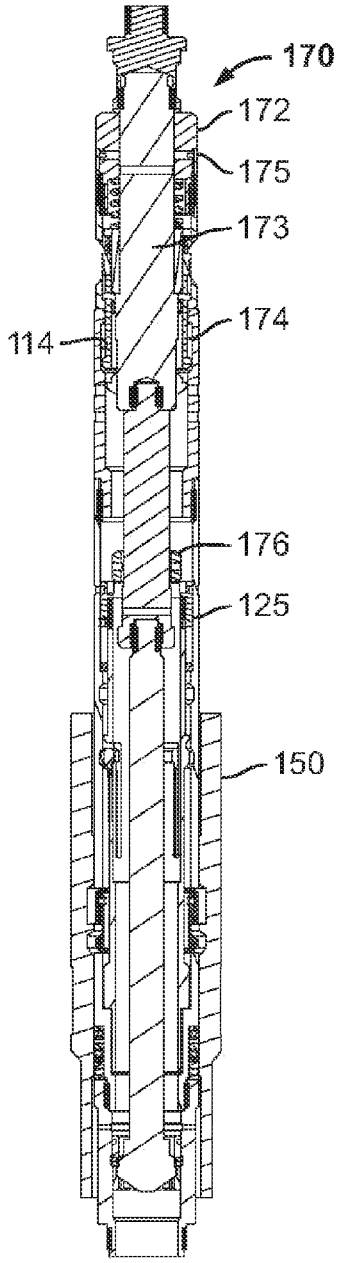

To retrieve the lock mandrel 110, operators run the retrieval tool 170 downhole as shown in FIG. 14A so that it latches into the internal fishing neck 114 of the lock mandrel 100 (Block 502). When latching, the collar 176 on the tool 170 initially contacts the inner mandrel 120 and pushes it down. Being moved, the inner mandrel 120 bottoms out, and the tool's dogs 174 engage in the fishing neck 114. Meanwhile, the equalizing prong 178 can open fluid communication through the equalizing assembly 140 if present.

Operators then jar up on the locked dogs 174 in the fishing neck 114 (Block 504). As shown in FIG. 14B, the inner mandrel 120 is still held down in the housing 110, and the keys 130 are now unsupported. When the tool 170 is raised, the tool's dogs 174 latch in the fishing neck 114, and the unsupported keys 130 can retract as the tool 170 lifts the mandrel 100 so it can be pulled uphole. There may be a situation where the retrieval tool 170 may need to be sheared away from the lock mandrel 100. To do this, operators bottom out the fishing neck 114 as shown in FIG. 14C. This shears the pulling tool's core 173 from the coupling 172 and the collar 176 (Block 506).

The foregoing description of preferred and other embodiments is not intended to limit or restrict the scope or applicability of the inventive concepts conceived of by the Applicants. For example, components of one embodiment disclosed herein can be exchanged or combined with components of another embodiment disclosed herein. Additionally, arrangements of components can be reversed. For example, the collet on the running tools can have uphole-extending fingers, while the inner mandrel has downhole extending fingers. As one skilled in the art will appreciate, terms such as up, down, uphole, downhole, run in, etc. are provided for relative reference and understanding, when directions in a given implementation may not necessarily be up/down or the like.

In exchange for disclosing the inventive concepts contained herein, the Applicants desire all patent rights afforded by the appended claims. Therefore, it is intended that the appended claims include all modifications and alterations to the full extent that they come within the scope of the following claims or the equivalents thereof.

What is claimed is:

1. A lock mandrel installation method, comprising:

attaching a lock mandrel to a running tool;

holding an inner mandrel in a downhole position in the lock mandrel with the running tool;

running in the lock mandrel with the running tool;

engaging a biased key disposed on the lock mandrel against a landing nipple profile while running in the lock mandrel;

releasing the hold on the inner mandrel in response to the engagement of the biased key against the landing nipple profile by pushing downhole on the running tool;

biasing the released inner mandrel to an uphole position in the lock mandrel;

locking the biased key in the landing nipple profile using a portion of the inner mandrel in the uphole position; and detaching the running tool from the lock mandrel.

2. The method of claim 1, wherein attaching the lock mandrel to the running tool comprises attaching the lock mandrel to the running tool using at least one shear pin.

3. The method of claim 2, wherein pushing downhole on the running tool comprises shearing a first of the at least one shear pins to release the hold on the inner mandrel.

4. The method of claim 2, wherein detaching the running tool from the lock mandrel comprises shearing a second of the at least one shear pins to detach the running tool from the lock mandrel by pulling uphole on the running tool.

5. The method of claim 1, wherein attaching the lock mandrel to the running tool comprises engaging a fishing neck dog on the running tool in a fishing neck of the lock mandrel.

6. The method of claim 5, wherein detaching the running tool from the lock mandrel comprises:

moving a groove on the running tool to the fishing neck dog by pushing downhole on the running tool;

disengaging the fishing neck dog from the fishing neck by retracting the fishing neck dog in the groove; and removing the retracted fishing neck dog and running tool from the fishing neck by pulling up on the running tool.

7. The method of claim 6, wherein moving the groove on the running tool to the fishing neck dog by pushing downhole on the running tool comprises shearing a shear pin holding two portions of the running tool together by jarring downhole on the running tool, one of the portions having the groove and moving downhole with the downhole jarring after shearing.

8. The method of claim 1, wherein engaging the biased key against the landing nipple profile comprises engaging a downhole-facing shoulder of the biased key against an uphole-facing shoulder of the landing nipple profile while running in the lock mandrel.

9. The method of claim 1, wherein the biased key is non-selectively biased toward an extended condition on the lock mandrel when run into the landing nipple profile.

10. The method of claim 1, wherein locking the biased key in the landing nipple profile using the portion of the inner mandrel comprises holding the biased key extended from the lock mandrel by fitting a widened flange of the inner mandrel against the biased key.

11. The method of claim 1, wherein running in the lock mandrel with the running tool comprises running the biased key selectively past the landing nipple profile by holding the biased key retracted on the lock mandrel.

12. The method of claim 11, wherein holding the biased key retracted comprises engaging the biased key with a catch on the inner mandrel.

13. The method of claim 11, wherein after running the biased key selectively past the landing nipple profile, the method further comprises:

running up the lock mandrel with the running tool; and releasing the hold on the biased key by engaging a locator dog on the running tool against a transition on the landing nipple when running up the lock mandrel.

14. The method of claim 13, further comprising:

running the biased key uphole from the landing nipple profile; and running in the lock mandrel to engage the biased key against the landing nipple profile.

15. A non-selective lock mandrel assembly, comprising:

a housing defining a bore with a downhole groove therein;

a key disposed on the housing and biased from a retracted condition to an extended condition, the key having a shoulder facing a downhole end of the housing;

an inner mandrel disposed in the housing and biased to move from a downhole position to an uphole position in the housing, the inner mandrel having a finger and a flange, the finger engaging the downhole groove to hold the inner mandrel in the downhole position, the flange moving with the inner mandrel and holding the key in the extended condition when the inner mandrel is in the uphole position; and a running tool detachably connecting to the housing, a portion of the running tool moving relative to the housing when the shoulder of the key in the extended condition engages in a landing nipple profile while running downhole, the moving portion of the running tool releasing temporary hold on the finger of the inner mandrel in the downhole groove and permitting the inner mandrel to move to the uphole position.

16. The assembly of claim 15, wherein the running tool comprises at least one shear pin breaking with downhole movement when the shoulder of the key engages in the landing nipple profile, the moving portion freed by the broken shear pin and having a collet releasing the temporary hold of the finger.

17. The assembly of claim 15, wherein:

a shear connection temporarily attaches the running tool to the lock mandrel; or a fishing neck dog disposed on the running tool temporarily engages in a fishing neck of the housing and attaches the lock mandrel to the running tool.

18. The assembly of claim 15, wherein:

a first biasing element disposed between the inner mandrel and the housing biases the inner mandrel toward the uphole position in the housing; and a second biasing element disposed between the key and the inner mandrel biases the key toward the extended condition.

19. The assembly of claim 15, wherein the housing defines an uphole groove in the bore disposed uphole of the downhole groove, and wherein the finger of the inner mandrel engages the uphole groove when the inner mandrel moves to the uphole position.

20. The assembly of claim 15, wherein the moving portion of the running tool comprises a collet movably disposed on the running tool, the collet in a first condition on the running tool being held by a temporary connection to the running tool and holding the finger of the inner mandrel in the downhole groove, the collet in a second condition on the running tool being free from the temporary connection to the running tool and releasing the hold on the finger.

21. The assembly of claim 15, wherein:

the lock mandrel comprises a melon disposed in the bore of the housing and movable therein between sealed and unsealed conditions relative to an equalizing port defined in the housing; and the running tool comprises a prong engaging the melon and moving the melon between the sealed and unsealed conditions with movement of the running tool.

22. The assembly of claim 15, wherein the biased key on the landing nipple profile comprises a downhole-facing shoulder engaging against an uphole-facing shoulder of the landing nipple profile while running in the lock mandrel.

23. The assembly of claim 15, wherein the biased key is non-selectively biased toward an extended condition on the lock mandrel when run in to the landing nipple profile.

24. A selective lock mandrel assembly, comprising:

a housing defining a bore with a downhole groove;

a key disposed on the housing and biased from a retracted condition to an extended condition, the key having a shoulder facing a downhole end of the housing;

an inner mandrel disposed in the housing and biased to move from a downhole position to an uphole position in the housing, the inner mandrel having a finger and a flange and temporarily holding the key in the retracted condition, the finger engaging the downhole groove to hold the inner mandrel in the downhole position, the flange moving with the inner mandrel and holding the key in the extended condition when the inner mandrel is in the uphole position; and a running tool detachably connecting to the housing and having a locator dog, the locator dog at least temporarily engaging a transition when run uphole to release the temporary hold of the inner mandrel on the key in the retracted condition, a portion of the running tool moving relative to the housing when the shoulder of the key in the extended condition engages in a landing nipple profile when run downhole, the moving portion of the running tool releasing temporary hold on the finger of the inner mandrel in the downhole groove and permitting the inner mandrel to move to the uphole position.

25. The assembly of claim 24, wherein the running tool comprises at least one shear pin breaking with downhole movement when the shoulder of the key engages in the landing nipple profile, the moving portion freed by the broken shear pin and having a collet releasing the temporary hold of the finger.

26. The assembly of claim 24, wherein the running tool comprises a fishing neck dog temporarily engaging in a fishing neck of the housing.

27. The assembly of claim 24, wherein the inner mandrel comprises a catch temporarily holding the key in the retracted condition, the catch releasing the hold of the key when the locator dog at least temporarily engages the transition when run uphole.

28. The assembly of claim 24, wherein:

a first biasing element disposed between the inner mandrel and the housing biases the inner mandrel toward the uphole position in the housing; and a second biasing element disposed between the key and the inner mandrel biases the key toward the extended condition.

29. The assembly of claim 24, wherein the housing defines an uphole groove in the bore disposed uphole of the downhole groove, and wherein the finger of the inner mandrel engages the uphole groove when the inner mandrel moves to the uphole position.

30. The assembly of claim 24, wherein the moving portion of the running tool comprises a collet movably disposed on the running tool, the collet in a first condition on the running tool being held by a temporary connection to the running tool and holding the finger of the inner mandrel in the downhole groove, the collet in a second condition on the running tool being free from the temporary connection to the running tool and releasing the hold on the finger.

31. The assembly of claim 24, wherein:

the lock mandrel comprises a melon disposed in the bore of the housing and movable therein between sealed and unsealed conditions relative to an equalizing port defined in the housing; and the running tool comprises a prong engaging the melon and moving the melon between the sealed and unsealed conditions with movement of the running tool.

32. The assembly of claim 24, wherein the biased key on the landing nipple profile comprises a downhole-facing shoulder engaging against an uphole-facing shoulder of the landing nipple profile while running in the lock mandrel.

* * * * *